United States Patent [19]

Kavanau et al.

[11] 4,215,479

[45] Aug. 5, 1980

[54] CAM DRIVEN CURVE TRACKING APPARATUS

[76] Inventors: Julian L. Kavanau, c/o University of California - Dept. of Biology, 405 Hilgard St., Los Angeles, Calif. 90024; Nils Jernberg, 268 Liberty Rd., Tappan, N.Y. 10983

[21] Appl. No.: 73,896

[22] Filed: Sep. 10, 1979

[51] Int. Cl.[3] ..... B43L 13/00

[52] U.S. Cl. ..... 33/27 K

[58] Field of Search ..... 33/27 R, 27 L, 27 K, 33/18 B

[56] References Cited

FOREIGN PATENT DOCUMENTS 290696 11/1931 Italy ..... 33/18 B

*Primary Examiner*—Harry N. Haroian

*Attorney, Agent, or Firm*—I. Morley Drucker

[57] ABSTRACT

An improved curve drawing apparatus of simplified construction has a base carrying a spindle about which are rotated interchangeable single or paired cams, a spring loaded cam follower movable along a Y-axis by one of the rotating cams, a second spring loaded cam follower mounted entirely on the first cam follower and movable independently along an X-axis by the same or a second rotating cam while simultaneously following the Y-axis movement of the first cam follower. A stylus arm is mounted on the second cam follower and traces the combined X-Y motion of the second cam follower to draw a curve which is determined by the shape of the cams. Multiple axes of cam rotation are provided for creating a variety of curves with a given cam or combination of cams and an interchangeable knob is included to facilitate manual rotation of the cams.

21 Claims, 13 Drawing Figures

Fig. 1
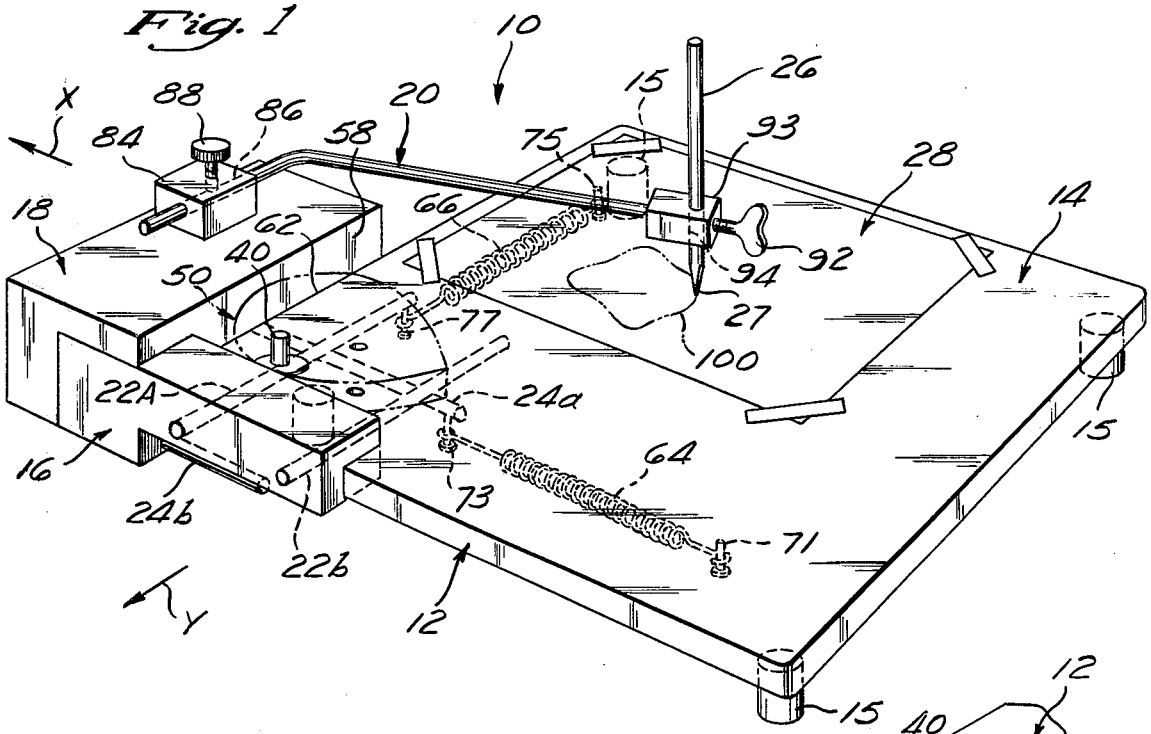
Fig. 2A
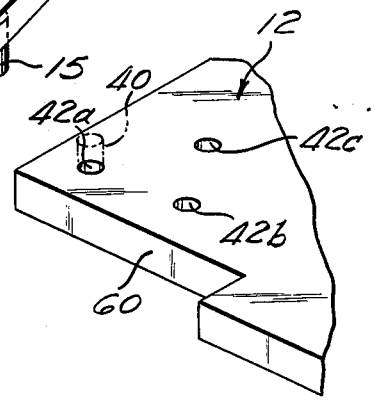
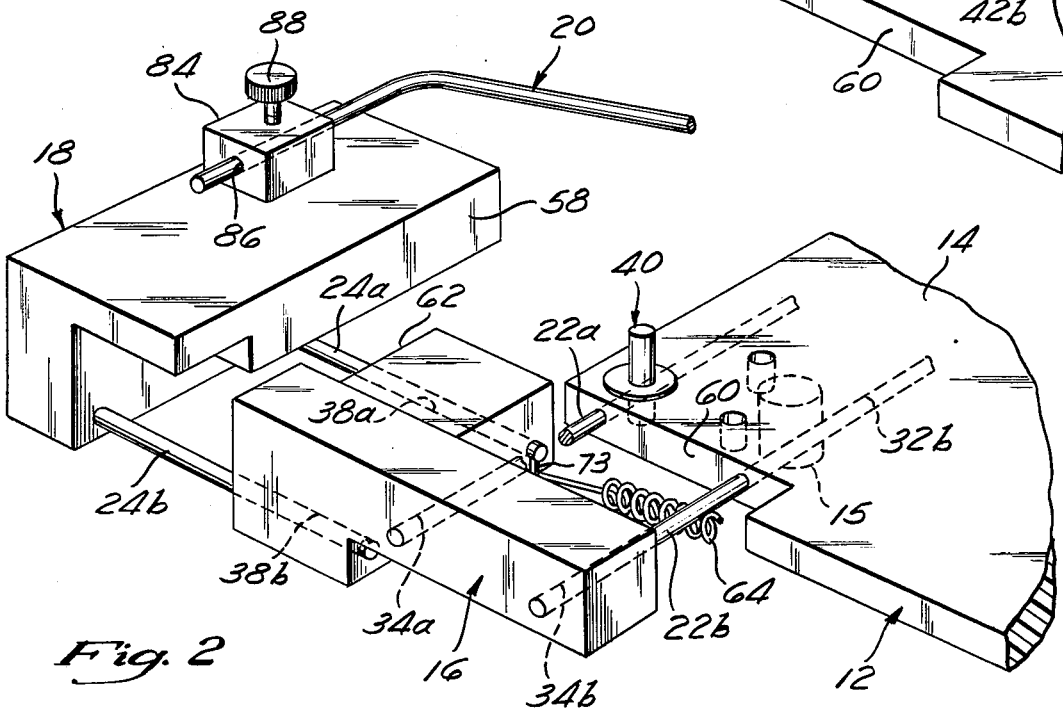
Fig. 2

Fig. 3
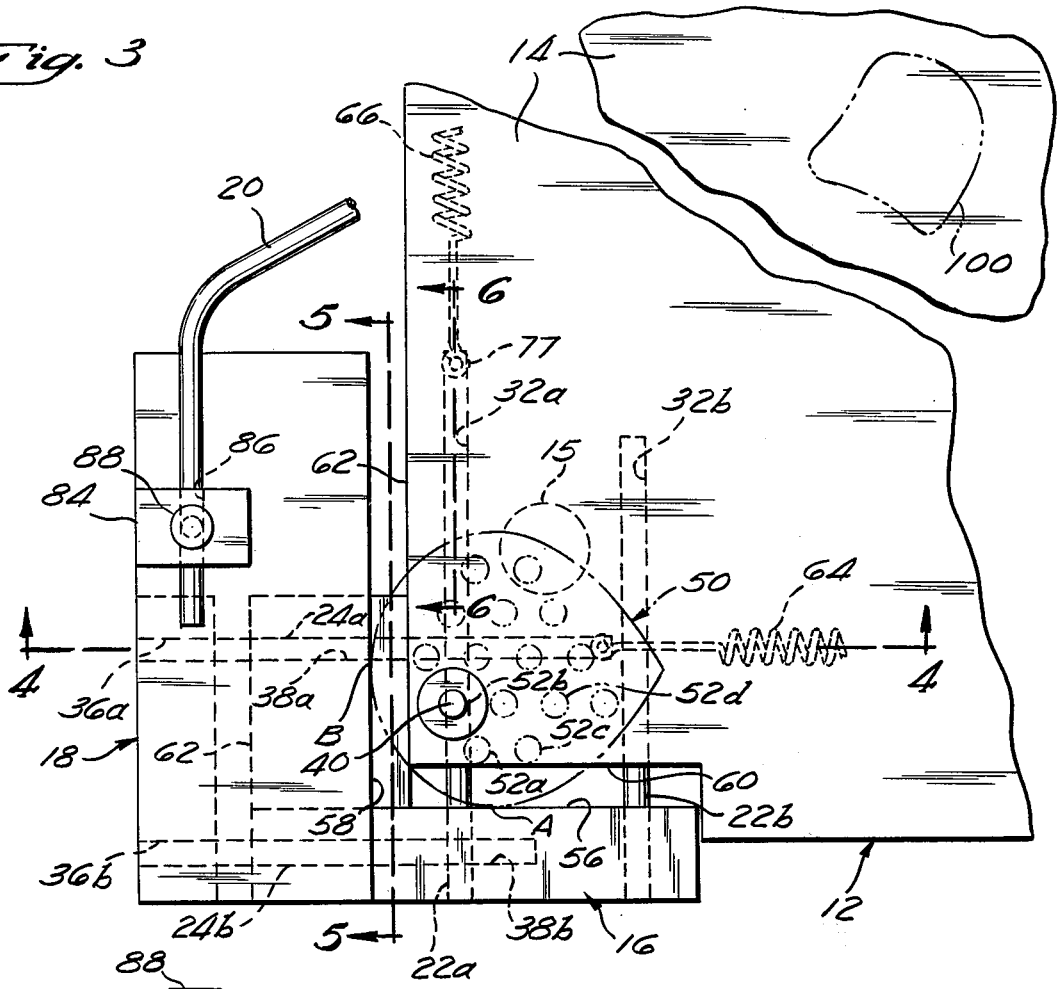
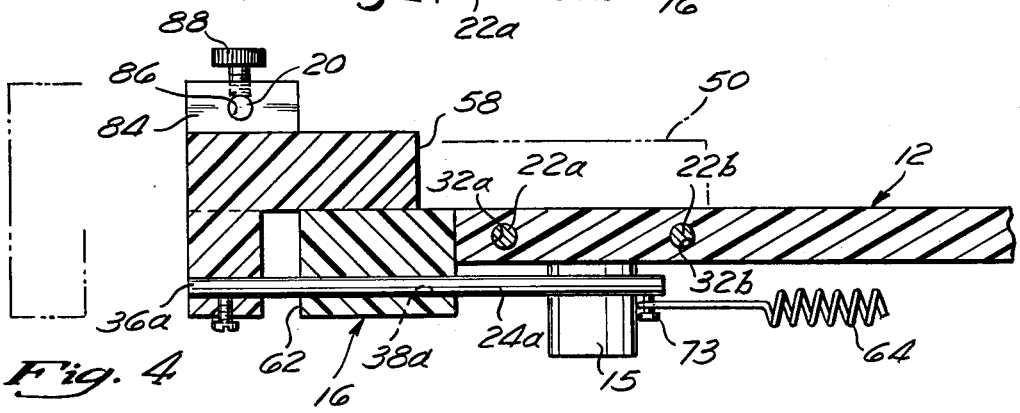
Fig. 4
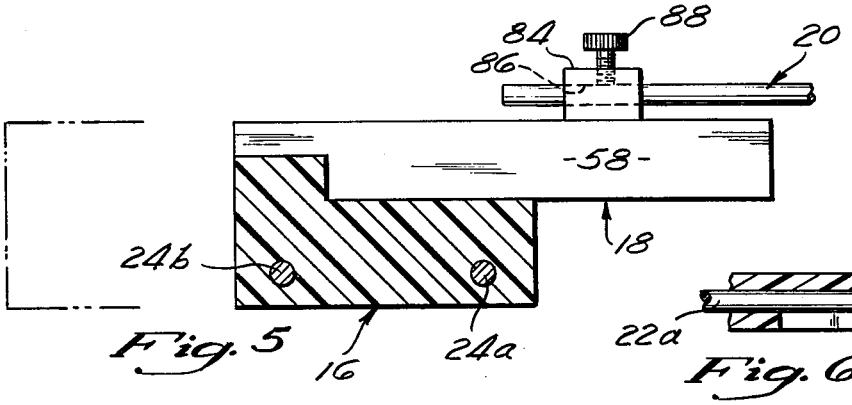
Fig. 5
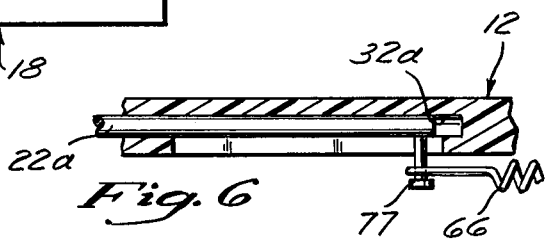
Fig. 6

Fig. 10
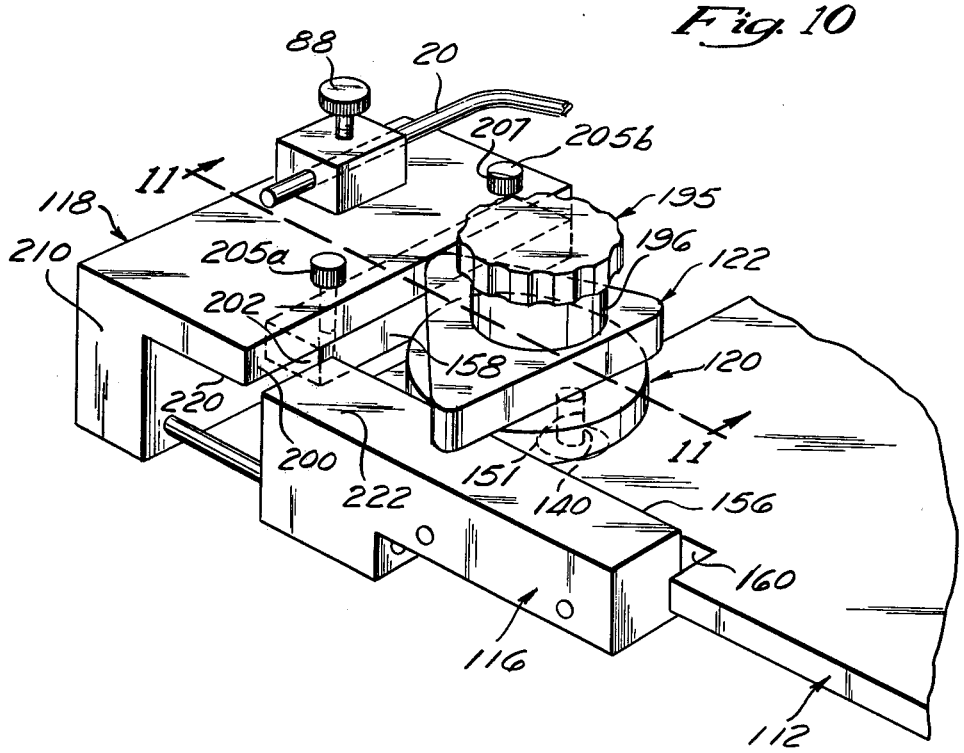
Fig. 11
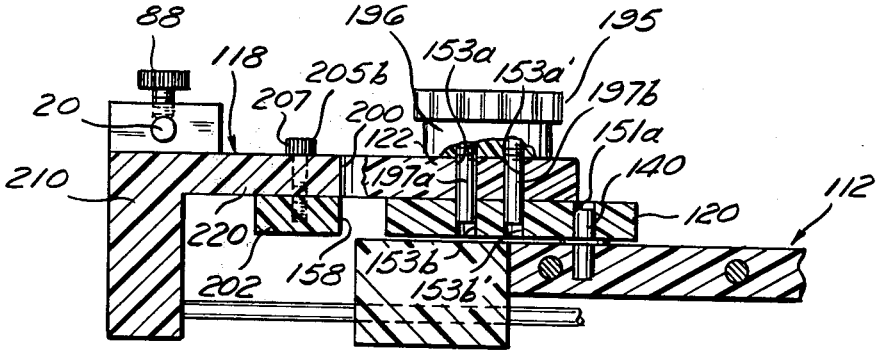
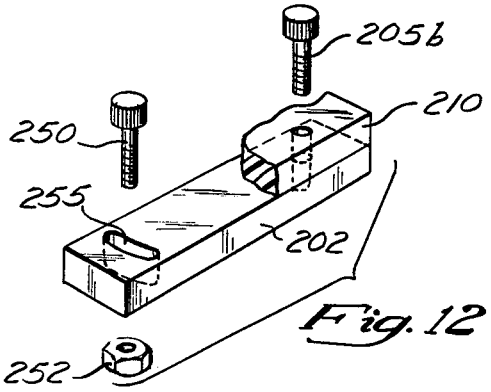
Fig. 12

CAM DRIVEN CURVE TRACKING APPARATUS

BACKGROUND OF THE INVENTION (a) Field of the Invention

This invention pertains generally to the field of automated drawing apparatus and, more particularly, to cam driven drawing devices such as pantographs.

(b) Statement of the Prior Art

Various cam driven devices for drawing curves are known. Most pertinent to this invention are U.S. Pat. No. 3,444,623 issued to Wolf on May 20, 1969 for a drawing toy and U.S. Pat. No. 3,834,027 issued to Amelon on Sept. 10, 1974, for a device for testing cam designs.

The Wolf device uses a pair of cam followers to drive a pair of crossed, spring loaded oscillating arms.

The arms move independently of each other, the motion being combined at the scribing means which moves along crossed slots in the arms, the crossing point determining the position of the scriber. This device suffers from severe drawbacks due to the limited sweep of arms and the fact that the path of the scriber is not a linear transformation of the cam patterns due to the pivotal mounting of the arms. That is, the oscillatory motion, rather than a linear one, of the cam followers introduces an element of distortion into the system.

Amelon attempts to correct the aforementioned deficiency by providing a pair of linearly movable cam followers. However, as in Wolf, the two cam followers move independently of each other and their motion is combined at the writing pen by a yoke arrangement which adds needlessly to the complexity and cost of the device.

SUMMARY OF THE INVENTION

The invention here disclosed overcomes the aforementioned shortcomings of the prior art. The apparatus comprises a supporting base provided with a pivot pin or spindle about which is rotated cam means of predetermined shapes.

A first cam follower is mounted on the base by means of guide rods sliding with low friction within channels formed in the base, allowing this cam follower to move along a Y-axis defined by the guide rods.

A second cam follower is similarly mounted by means of a second set of guide rods and corresponding guide channels, onto the first cam follower. This second set of guide rods permits linear movement of the second cam follower along an X-axis relative to both the first cam follower and the base portion. Both first and second cam followers are spring biased towards a zero position and the apparatus is so constructed that the rotating cam or cams will cause the cam followers to be displaced, against this spring tension, along their respective axes.

Thus, while each cam follower is responsive only to a force component exerted by the rotating cam or cams along the axis defined by the cam followers' corresponding guide rods, the second cam follower is simultaneously also impressed with the movement imparted to the first cam follower, since the former is entirely mounted upon the latter. It therefore follows that the motion of the second cam follower is the vector sum of the separate X and Y components of motion of the respective cam followers.

The path followed by the second cam follower, which path is completely determined by the shape of the rotating cam or cams, can be traced on a surface such as a sheet of paper by means of a stylus means rigidly affixed to the second cam follower.

It will be apparent from the foregoing that no separate mixing means are necessary to combine the independent X and Y components acting on each of the two cam followers, unlike the devices of the patented art cited above. It is this feature which allows the direct rigid mounting of the stylus directly to the second cam follower only. Such additional "mixing" means add to the cost and complexity of the apparatus, and also introduce a source of mechanical friction and possible distortion into the system. The need for such a mechanism has been completely eliminated in this invention due to the novel and unobvious structure which is described in the following detailed description.

This invention lends itself to many uses and applications.

Instructional uses, e.g., in the Teaching of Geometry include:

location and ranking of foci of figures generation of familiar and unfamiliar transforms curves by rotating other familiar or unfamiliar basis curves about specific points relationships between curves Possible Research uses are investigating the properties of curves and intercept transforms (the curves generated by rotating a basis curve about specific points) and employing the device as a geometrical analogue computer Toy Applications for inventing and drawing curves by children children may cut out basis curve cams of their own design and invent new curves Artistic applications include creative development of new curves and figures and employment thereof in art work, and Commercial artists may generate the master patterns of figures and curves for decorating tiles, wallpaper, borders, exteriors of boxes and other decorative purposes.

The above list is not intended to be exhaustive by any means, as other uses will no doubt be found by individuals in many fields of endeavor.

BRIEF DESCRIPTION OF THE DRAWINGS

FIG. 1 is a perspective view of the curve tracing apparatus of this invention, with a single cam of one possible cam design shown in phantom line and with the corresponding curve traced by the stylus, also in phantom line;

FIG. 2 is an enlarged exploded view of the cam followers and corresponding guide means of FIG. 1;

FIG. 2*a* is an enlarged, fragmentary, perspective view of the left-hand lower corner of base 12 with the cam and cam followers and associated mechanism being removed therefrom;

FIG. 3 is a top plan view of FIG. 1, where a portion of the stylus arm and the base tracing surface have been broken away;

FIG. 4 is a cross-section taken along line 4—4 of FIG. 3;

FIG. 5 is a cross-section taken along line 5—5 of FIG. 3;

FIG. 6 is a cross-section taken along 6—6 of FIG. 3;

FIG. 10 is a fragmentary, perspective, view of the cam follower mechanism and cam means of a second embodiment of the invention;

FIG. 11 is a cross-section taken along line 11—11 of FIG. 10; and

FIG. 12 is a fragmentary perspective view of a third embodiment of this invention.

DETAILED DESCRIPTION OF THE INVENTION

Figure 7:
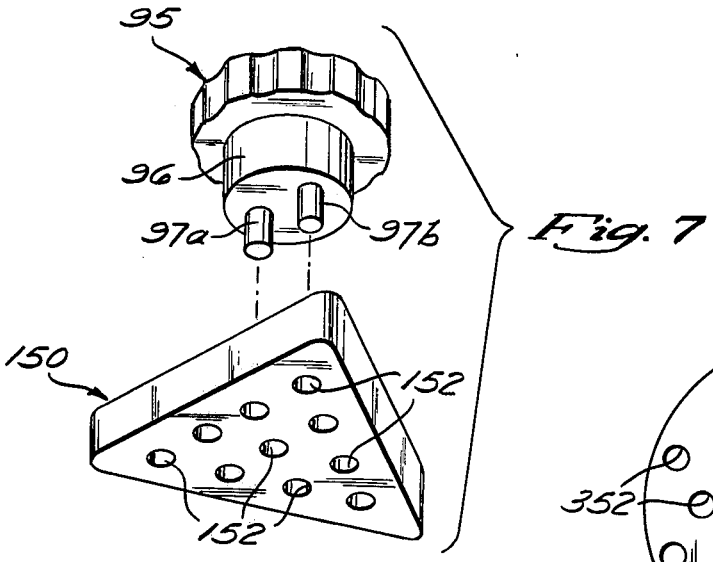
FIG. 7 is an exploded perspective view of the interchangeable cam knob or handle and a triangular cam with multiple openings for multiple cam placements.

Referring now to the drawings and especially FIGS. 1–3 thereof, it will be seen that the device of this invention is provided with a base portion 12 including an upper planar support surface 14, here shown as an integral extension thereof. A spindle means such as spindle 40 is mounted on said base and a cam means 50 is mounted for rotation about spindle 40. A first cam follower block 16 is operatively engaged to the base 12 for movement only along a Y-axis responsive to a Y component generated by rotation of cam means 50. A second cam follower 18 block is mounted to the first cam follower 16 through guide means such as guide rods **24*a* and 24*b* so that second cam follower 18 is constrained to movement of the first cam follower 16 along the Y-axis, but enabling independent movement of the second cam follower along an X component generated by rotation of cam means 50. Thus, the motion of the second cam follower 18 relative to the base 12 is the vector sum of the Y component and the X component. Spring means, shown as springs 64 and 66 operate to bias the first and second cam followers 16 and 18, respectively to a zero position with respect to the X and Y axes. A stylus means or pen 26 is rigidly affixed to the second cam follower 18, for tracing on support surface 14 a curve 100 determined by the movement of the second cam follower 18**.

FIG. 2 shows in greater detail the base portion 12 which is extended to define support surface 14 and is provided with four legs 15. Although support surface 14 is shown extending from and integrally affixed to base 12, it will be understood that the support surface 14 may be entirely separate, such as a table top or drafting board. The device is then operated by placing or clamping base 12 on the separate support surface so that stylus means 26 may trace a curve 100 over the separate support surface 14.

A spindle or pivot pin 40 is inserted, as by a friction fit, in one of several spindle receiving openings **42*a, b, c* . . . formed in base 12. Spindle 40 may be selectively manually relocated at will in any of such openings 42*a, b, c* . . . , which are preferably disposed in a closely spaced series or gridwork of holes occupying an area of several square inches on base 12**. This arrangement permits, for example, the use of cams of different sizes in a manner which will be described.

Turning now to FIG. 3, a teardrop shaped cam 50, shown in phantom line, is slidably mounted onto spindle 40 for rotation at one of a plurality of holes **52*a, b, c,* etc. provided in cam 50. Sprindle 40 thus provides an axis about which cam 50** may be rotated either manually, as in the embodiment illustrated in the drawings, or by motor means not shown here.

The operative engagement of the first cam follower block 16 and base 12, and the mounting of the second cam follower 18 to the first cam follower 16, which is best understood from FIGS. 3–6 is as follows.

A pair of parallel guide channels **32*a* and 32*b* are formed in base 12. Guide rods 22*a* and 22*b* are affixed at ends 34*a* and 34*b* to the first cam follower block 16 and their opposite, free ends fit snugly within slots or guide channels 32*a* and 32*b* (the channels 32*a*, 32*b* preferably being lined by roller bearings), so that guide rods 22*a*, 22*b* may slide smoothly and easily within said channels, towards and away from base 12** without any undue looseness to minimize lateral movement.

The second cam follower block 18 is mounted in a similar manner by guide rods **24*a* and 24*b* affixed thereto at their respective ends 36*a* and 36*b*, leaving the remainder of the guide rods free to slide within a corresponding pair of guide channels 38*a* and 38*b* formed in the first cam follower block 16. Thus, the second cam follower 18 is free to slide independently of the first cam follower 16 relative to the base 12, but is also carried piggy-back fashion on the first cam follower 16** and therefore follows every movement made by the latter.

As seen in FIG. 3, cam 50 makes contact with a drive edge 56 of the first cam follower block 16, at point A, and also makes simultaneous contact with a drive edge 58 of the second cam follower block 18 at point B. Both cam follower blocks 16 and 18 are continuously urged by spring means such as tension springs 64 and 66 towards stop edge 60 on base 12 and stop edge 62, on cam follower 16, respectively, which edges define an initial or zero position for the cam followers with respect to the X-Y axes discussed below. As shown in FIGS. 1, 3, 4 and 5, each of springs 64 and 66 is anchored at one end to the free end of a guide rod of one of the cam followers and at the other end anchored to points on the base 12.

Thus, spring 64 is stretched between anchor post 71 in base 12 and anchor pin 73 of guide rod **24*a*. Similarly, spring 66 is stretched between anchor post 75 and anchor pin 77 on guide rod 22*a*. In the absence of any force urging cam followers 16 and 18 against the tension of springs 64 and 66, both cam followers will be at rest in the zero position, as just described and as shown in FIG. 1, against stop edges 60 and 62**, respectively. It is understood that the spring means may be affixed directly to the respective cam followers.

It will be appreciated that the guide means which comprise guide rods pairs **22*a*, 22*b* and 24*a*, 24*b*, together with the corresponding guide channel pairs 32*a*, 32*b* and 38*a*, 38*b*, define an X-Y coordinate system, where each cam follower is guided for movement along one such coordinate axis against a spring bias. The assembly of a guide rod within a guide channel 32*a* is best understood from FIG. 6, also showing a portion of spring 66 attached to anchor pin 77 of the guide rod 22*a*. In the embodiment illustrated in the attached drawings, the coordinate axes are norma to each other as is best understood from FIG. 3. As seen there, the parallel guide rods 22*a* and 22*b* of the first cam follower 16 are disposed at a 90° angle to the parallel guide rods 24*a*** and 24*b* of second cam follower 18, such that the movement of the cam followers is along perpendicular straight lines. It is understood that angles other than 90° between the coordinates are within the scope of this invention and that a single guide rod, of suitable cross-section to prevent rotation, may replace each of the guide rod pairs 22*a*, 22*b* and 24*a*, 26*b*.

It is further understood that drive edge 58 may be pivoted to alter the angle at which it interfaces with the cam means and that the guide rods may be curved rather than straight rods provided the corresponding guide channels are similarly curved to thus create a pair of curved axes and which pair may be formed at a variety of angles relative to each other.

The operation of the invention is as follows:

The cam means of predetermined shape, e.g., 50, is mounted onto spindle 40. Depending on the particular cam shape it is normally necessary to manually move the cam follower blocks away from their zero position to permit mounting of the cam on the spindle 40 so that a portion of the cam 50 is interposed between the spindle 40 and the drive edges 56 and 58.

When the cam means, such as cam 50, is rotated about spindle 40 the cam dimensions between the spindle 40 and the drive edges 56 and 58 of cam followers 16 and 18 will change in a way which depends on the geometry of the particular cam.

Each of the drive edges 56, 58, being biased toward a zero position, will be displaced from such zero position in strict accordance with an X-force component and a Y-force component generated by the rotating cam; each force component acting independently on one of the individual drive edges 56, 58 to induce independent motion of the first and second cam follower blocks 16 and 18.

However, since the second cam follower 18 is carried entirely by the first cam follower 16 as described above, the motion of the latter is necessarily transmitted to the former, i.e., the force component (e.g., the X-component) acting upon the drive edge 56 of the first cam follower 16 is simultaneously and frictionlessly impressed upon the second cam follower 18 by virtue of the aforedescribed piggy-back mounting. Simultaneously, an independent force (e.g., the Y-axis component) may act upon the drive edge 58 of the second cam follower without affecting the motion of the first cam follower block 16. Thus, one force component acts directly on the second cam follower while another force component is impressed upon the second cam follower only by virtue of its being carried by the first cam follower, the latter being the direct recipient of that other force component. The overall result following from the above is that the motion of the second cam follower 18 is representative of the vector sum of the X, Y force components each acting independently on one of the cam follower drive edges 56 and 58.

Affixed to cam follower block 18 is a stylus retaining extension arm 20. Extension arm 20 comprises, preferably, a hollow, lightweight length of tubing such as aluminum tubing, and is rigidly affixed at one end to the second cam follower 18 by means of a mounting block 84, which block 84 is affixed to cam follower block 18 as by gluing. Mounting block 84 is provided with a bore 86 within which extension arm 20 is securely retained by means of set screw 88. At the free end of arm 20 is a stylus-retaining block 93 having a generally vertical bore 94 passing therethrough and in which is secured a stylus means 26 by means of a set screw 92. Stylus means 26 may be chosen from a variety of writing or drafting implements, but may advantageously be a low cost fiber tip ink pen, which are available in a wide assortment of ink colors. The position of the extension arm 20 and stylus 26 may be adjusted by temporarily loosening the respective set screws 88 and 92. The ensure firm and uninterrupted contact of the writing tip 27 of stylus 26 with surface 28 while the cam followers 16 and 18 are driven by cam 50, the stylus arm 20 preferably should be weighted as by block 93 or is lightly spring loaded.

By way of example, FIGS. 1 and 3 illustrate a curve 100 traced as a result of one complete revolution of teardrop shaped cam 50. A great variety of unusual and intricate geometric curves can be generated in this manner. The device constructed according to the teachings of the present disclosure has several potential fields of application; among others, it is useful as a research tool for studying mathematical transformation functions, as a geometrical analogue computer, as a teaching aid, and also as a toy for generating novel and interesting patterns.

Figure 8:
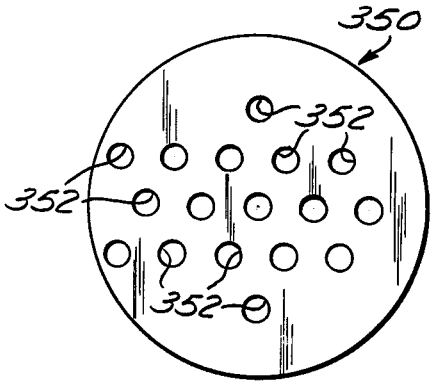
FIG. 8 is a circular cam, in plan view, showing the multiple openings, each of which is adapted to receive either the spindle or one of the pins extending from the knob body.
Figure 9:
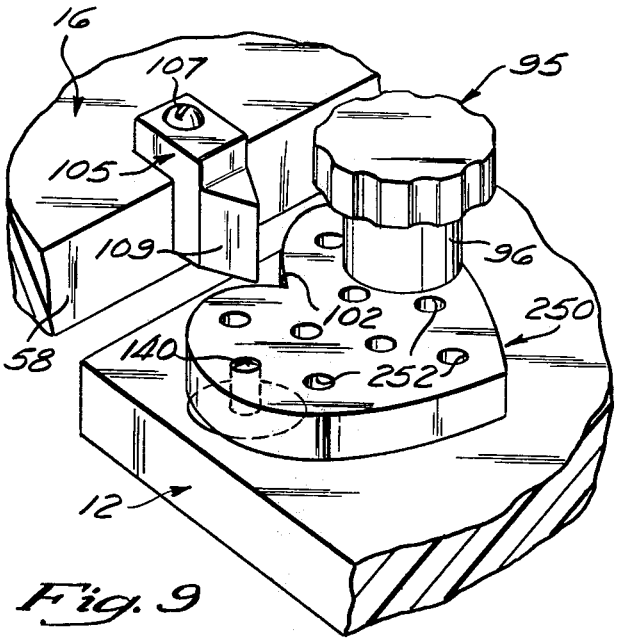
FIG. 9 is an enlarged fragmentary, perspective view of a heart-shaped cam fitted onto the base spindle and showing also a cam follower fitted with a projection member capable of closely following the concavity of the heart-shaped cam.

In FIGS. 7, 8 and 9, are shown three additional cam shape embodiments, respectively, a triangle 150 (with slightly rounded corners), a circle 350 and a stylized heart shape 250. Each of these interchangeable cams 150, 250, 350 has a plurality of openings 52, 152, 252, respectively, (the exact number is not critical) or spindle receiving holes 52. The reason for the multiple holes 152, 252, 352 is that a given cam shape will generate a different sized or different shaped curve 100 depending on the location of the axis of rotation of the cam. Thus, any of the holes 152, 252, 352 may be used for mounting a spindle 40 thereinto, increasing the variety of curves 100 that may be created with the aid of this invention.

A detachable handle or knob 95 shown in FIGS. 7 and 9 is of sufficient size that it may be grasped easily with several fingers of the operators hand and is a very helpful tool for manually rotating the various cam means 150, 250, 350. For this purpose, knob 95 consists of a knob body 96 from the lower end of which extend pin means such as a pair of vertical, parallel attachment pins 97*a* and 97*b*. The spacing between the holes 152, 252, 352 in all cam means 150, 250, 350 is preferably such that the center to center distance between any adjacent pair of holes is equal to the center to center spacing between attachment pins 97*a* and 97*b* so that knob 95 may be inserted into selected holes, e.g., holes 152 of cam 150. The knob 95 is interchangeable between the cams and is easily engaged by simply sliding pins 97*a* and 97*b* at any conveniently available location, after a particular cam has been selected and mounted on spindle 40 at a selected hole pair for rotation thereabout. Knob 95 is just as quickly removed by pulling upwardly on it while holding down the cams 150, 250, 350 to disengage pins 97*a* and 97*b* from the cam means.

As shown in FIGS. 1–6, the cam follower driving edges 56 and 58 each present a plane surface to the cam means 50. It will be apparent to those skilled in the art that the shape of these cam follower drive edges will affect the shape of the resultant curve 100. That is, the kind of cam follower driving edge is a factor in the mathematical transformation between the geometry of the cam means and the geometry of the resulting curve 100. For example, different results would be obtained if one or both edges 56 and 58 were curved in the plane defined by the coordinate system of this device.

Planar driving edges 56, 58 are not capable of following faithfully minor indentations or concavities in the cam means, as for, example, the dimple 102 in the heart-shaped cam means 250 of FIG. 9. When such close following of an indented cam is desired, a low-friction, V-shaped, pointed projection means 105 may be removably attached to one or both cam follower blocks 16 and 18, as by means of a threaded screw 107. The projection member 105 is preferably generally shaped as an inverted L overhanging the driving edge 58 so that the V-shaped portion 109 is interposed between the cam means 250 and the cam follower driving edge 58. A plurality of mounting slots (not shown) may be provided in the cam follower blocks for selective location of projections 105 along the drive edges 56, 58.

It will be further understood that other guide means may be employed instead of the guide rod-guide channel combination described above. As one example of an alternate guide means, an extensible scissors-lattice of the type used in jacks and for mounting lamps can be substituted, particularly where large excursions of the drive edges are anticipated.

In a second embodiment of this invention shown in FIGS. 10 and 11, provision has been made for independently driving each of the first and second cam followers by means of separate first and second cam means. The variety and complexity of the resultant curves 100 is thereby greatly increased, further adding to the value of this invention. A novel means of interfacing cam means pairs is included providing quick mounting exchange and disassembly of plural cam means juxtaposed in overlying relationship, i.e., piggy-backed.

As shown in FIGS. 10 and 11, a pair of stacked, overlying, or piggy-backed mounted cam means include a first cam means 120 which is rotatably mounted on spindle 140 at spindle receiving hole 151*a*. A second cam means 122 overlies first cam means 120 and is non-rotatably secured thereto by means of knob 195, as will be described, such that cam 122 must follow the rotation of cam 120 about spindle 140.

In this second embodiment of FIGS. 10 and 11, the driving edge 158 of second cam follower 118 includes an upper portion 200 which is integral with the body 210 of cam follower 118, and a removable lower portion 202.

The lower portion 202 is detachably secured to the integral upper portion 200 preferably by means of a pair of machine screws 205*a* and 205 passing through aligned, threaded bores in said upper and lower portions 200 and 202. Screws 205*a* and 205*b* have knurled heads 207 to facilitate manual disengagement thereof for removal of lower portion 202.

So long as the lower portion 202 remains secured to the second cam follower 118, as in FIGS. 10 and 11, the device functions in a manner analogous to the embodiment first described above having a unitary driving edge 58 on second cam follower 18 in FIGS. 2 and 4. That is, both cam followers 116 and 118 in FIGS. 10, 11 can be drivingly engaged by a single cam means, e.g., 120 on spindle 140. When lower portion 202 is detached, however, the driving edges 156 and 158 of first and second cam followers 116 and 118, respectively, become vertically staggered, i.e., the lower end 220 of upper portion 200 of driving edge 158 is sufficiently spaced from base 112 to clear the upper end 222 of driving edge 156 of first cam follower 116 and also to provide clearance for radial excursions of the first or lower cam means 120 underneath said lower end 220. Thus, once removable portion 202 is removed, the second cam follower 118 is no longer responsive to rotation of the first cam means 120.

A second cam follower 122 is overlyingly mounted (in piggy-back fashion) onto the first cam follower 120 and secured thereto by parallel pin means 197*a* and 197*b* extending downwardly from the lower end 196 of knob body 195. While detail has been omitted for clarity in the cam means 120 and 122 of FIGS. 10 and 11, said cam means 120 and 122 include an array of pin receiving holes equivalent to that of cam means 50 of FIGS. 7 and 8. Thus, cams 120 and 122 are interfaced or piggy-backed by first stacking said cams so that a first selected pair of pin receiving holes 153*a* and 153*a*' in cam means 122 is aligned with a second selected pair of pin receiving holes 153*b* and 153*b*' in cam means 120, and then inserting the parallel pin means 197*a*, 197*b* through the pair of pin receiving holes 153*a* and 153*a*' of upper cam means 122 and partially into the aligned pair of pin receiving holes 153*b* and 153*b*' of lower cam means 120, thus interlocking both upper and lower cam means so that both are simultaneously rotated by manually turning knob 195 about spindle 140.

When the cam means 120, 122 are so stacked, the upper cam means 122 is raised to the level of the upper portion 200 of driving edge 158 and engages only the said upper portions 200, i.e., cam means 122 clears the upper face 222 of first cam follower 116.

The overall result of the staggered driving edges 156 and 158 and the stacked cam means 120 and 122 is that the first cam follower 116 is solely responsive to a Y component generated by rotation of lower cam means 120 while the second cam follower 118 is independently and solely responsive to an X-component generated by rotation of upper cam means 122. Thus, as explained in connection with the first embodiment the overall movement of second cam follower 118 will be the vector sum of said Y component and X component, which components are independently generated by first cam means 120 and second cam means 122, respectively.

It will be readily appreciated that a very great number of cam means combinations are possible. For any given pair of cam shapes, a great number of resultant combinations may be obtained by selectively aligning different pairs of pin receiving holes 52 in said cam means, each selection yielding a different X-Y vector sum. Of course, the stacking order of the cams may be reversed to change the orientation of the resulting curve. Further, combinations result from the many possible selections of cam means.

It will be noted that all the changes just described are accomplished quickly and effortlessly by the novel interfacing of the first and second cam means by means of knob 195. Further, any given combination may be easily and accurately repeated at any time.

In a further variation of this drawing device shown in FIG. 12, the lower block portion 202 may be pivotally mounted for pivotol movement with respect to body 210, e.g., block portion 202 may be secured to body portion 210 by, and pivotted about, screw 205 so that angles other than 90° may be obtained between the driving edges of the first and second cam followers 116 and 118, respectively. The pivoting block portion 202 may be secured at a predetermined angular relationship with respect to cam follower 116 by means of screw 250 and locking nut 252 combination, (which replace screw 205*a* of FIG. 11) as shown in FIG. 12. Block portion 202 is moved radially about the machine screw 205*b* pivot pin, within the limits defined by curvilinear slot 255, and then fixed in position by nut 252.

It will be appreciated by those skilled in the art that while the second cam follower 118 has been described as drivingly engageable by the upper cam means 122, with the lower cam means 120 drivingly engaging the first cam follower 116, this cam means—cam follower relationship may be reversed without departing from the spirit and scope of this invention.

The device of this invention can be made from various materials or combinations thereof. For example, the base 12 and the cam follower blocks 16, 18 may be formed of an acrylic plastic while the guide rods **22*a*, 22*b*, 24*a*, 24*b* can be made of steel. It is important to use low friction materials for the cam means and the drive edges 56 and 58. Suitable materials, among others, are Nylon, Teflon®, and Delrin plastic. In lower cost versions of this invention, suitable for use by children, the apparatus may be made of wood or cardboard, and rubber bands may be used as the spring means 64 and 66**.

It is understood that the designation of an X-axis and a Y-axis throughout this specification and claims may be reversed and such designation is not intended to limit the scope of the invention in any manner.

Various changes and modifications of the embodiment here described will occur to those skilled in the art, therefore, Applicant intends to be bound only by the claims which follow.

What is claimed is:

1. A drawing apparatus for drawing geometric curves generated by a cam means which comprises, in combination:

a base;

spindle means mounted on said base;

cam means rotatably mounted on said spindle means;

a first cam follower operatively engaged to said base for movement only along a Y axis responsive to a Y component generated by said rotating cam means;

a second cam follower;

guide means for mounting said second cam follower to said first cam follower to constrain said second cam follower to movement of said first cam follower along the Y axis but enabling independent movement of said second cam follower along an X axis responsive to an X component generated by said cam means whereby the motion of said second cam follower relative to said base is the vector sum of said Y component and said X component;

spring means operative to bias said first and second cam followers to a zero position with respect to said X and Y axis; and stylus means rigidly affixed to said second cam follower for tracing a curve thus determined by said cam means.

2. The device of claim 1 further comprising first and second guide means for guiding the movement of said first and second cam followers, respectively, thus defining said Y axis and said X axis, respectively.

3. The device of claim 2 wherein each said guide means comprises one or more guide rods extending from said first and second cam followers and slidable within corresponding guide channels formed in said base and said first cam follower, respectively.

4. The device of claim 1 wherein said base has a plurality of spindle receiving openings formed therein for selectively locating said spindle therein.

5. The device of claim 2 wherein said guide means comprise first and second pairs of guide rods sliding in corresponding first and second guide channel pairs, said first guide means being perpendicular to said second guide means to thereby define perpendicular X and Y axes.

6. The device of claim 1 which further comprises an extension arm rigidly affixed at one end to said second cam follower, a stylus holding block at the free end of said arm having a bore provided therein for securing said stylus within said bore.

7. The device of claim 1 wherein said spring means are a pair of tension springs each affixed to one of said cam followers at one end, and to said base at the other end, to thereby bias said cam followers towards a zero position.

8. The device of claim 3 wherein each of said spring means is affixed at one end of said guide rods of one of said cam followers and at the other end to an anchor point located on said base, such that each spring means biases one of the cam followers towards a zero position.

9. The device of claim 1 wherein each said cam follower further includes a driving edge which is driven by rotation of said cam means for movement of each said cam follower.

10. The device of claim 1 wherein each said cam follower is further provided with a pointed projection member for closely following indentations in said cams.

11. The device of claim 9, wherein at least one of said drive edges may be pivoted with respect to the other drawing edge to present a different angle to the cam means.

12. The device of claim 1 further comprising interchangeable cam means having a shape selected from the group consisting of a circle, a triangle, a drop shape, and a heart shape.

13. The device of claim 11 wherein said interchangeable cam means further comprise cams having indentations therein.

14. The device of claim 1 further comprising interchangeable cam means, each said cam means having a plurality of holes formed therein, each hole being adapted to receive said spindle for rotation of said cam, whereby different curves may be generated by changing the location of said spindle in said cam.

15. The device of claim 14 further comprising a knob body having pin means extending therefrom, which pin means may be inserted in selected holes in said cam means to facilitate manual rotation of said cam means about said spindle.

16. The device of claim 15 wherein said pin means comprises two spaced vertical pins and wherein the spacing between any adjacent pair of holes in said cam means is equal to the spacing between said pins of said knob body.

17. The drawing apparatus of claim 1 further including a drawing surface integral with said stylus means being positioned to trace a curve on said drawing support surface.

18. The drawing device of claims 1 or 17, said cam means including separate stacked upper and lower cam means, said second cam follower comprising an integral upper portion and a removable lower block portion, the removal of said lower block portion rendering said second cam follower non-responsive to said lower cam means and responsive only to said upper cam means.

19. The drawing device of claim 18 wherein said removable lower block portion is angularly adjustable with respect to said X axis.

20. The drawing device of claims 13 or 14 wherein said interchangeable cam means includes an upper cam means and a lower cam means and further includes a knob body having pin means extending therefrom which pin means are insertable through a selected first pair of pin receiving holes provided in said upper cam means, said pin means also extending into an aligned selected second pair of pin receiving holes in said lower cam means for simultaneous rotation of said upper and lower cam means by means of said knob body.

21. The device of claim 9 wherein at least one of said driving edges is angularly adjustable relative to the axis of movement of said cam follower.

* * * * *